US005402921A

United States Patent [19]

Forsyth et al.

[11] Patent Number: 5,402,921

[45] Date of Patent: Apr. 4, 1995

[54] ROTOR-TYPE DISPENSER

[76] Inventors: Michael J. Forsyth, 1941 Marhofer Ave., Stow, Ohio 44224; Bruno A. Mediate, 6999 Ivandale Dr., Independence, Ohio 44131; David E. Pecot, 8432 Timber Trail, Brecksville, Ohio 44141

[21] Appl. No.: 104,854

[22] Filed: Aug. 10, 1993

Related U.S. Application Data

[63] Continuation of Ser. No. 808,372, Dec. 16, 1991, abandoned.

[51] Int. Cl.[6] ..... B65D 47/00

[52] U.S. Cl. ..... 222/541; 222/548; 222/565; 220/253; 220/258; 220/266

[58] Field of Search ..... 222/480, 516, 541, 548, 222/554, 556, 565, 555; 220/253, 258, 259, 266, 339, 359

[56] References Cited

U.S. PATENT DOCUMENTS

| | | | |
|---|---|---|---|
| 982,070 | 1/1911 | Johnson . | |
| 2,931,541 | 4/1960 | Southwell | 222/548 X |
| 2,961,132 | 11/1960 | Ankney | 222/480 |
| 3,782,583 | 1/1974 | Abbey | 220/339 |
| 3,851,792 | 12/1974 | Ankney | 220/253 |
| 3,851,812 | 12/1974 | Bittel | 229/5.5 |
| 3,871,550 | 3/1975 | Chiappe | 220/339 |
| 3,881,639 | 5/1975 | Herip | 222/153 |
| 3,907,156 | 9/1975 | Weatherhead, III | 222/307 |
| 3,907,193 | 9/1975 | Heller | 220/339 X |
| 3,912,128 | 10/1975 | Ziemann et al. | 222/541 |
| 3,948,415 | 4/1976 | Debenham | 220/268 |
| 3,952,912 | 4/1976 | Perry | 220/269 |
| 3,980,200 | 9/1976 | Klein | 220/268 |
| 4,054,228 | 10/1977 | Balocca et al. | 220/268 |
| 4,155,481 | 5/1979 | Takahashi et al. | 220/270 |
| 4,165,015 | 8/1979 | Hasegawa | 220/269 |
| 4,211,336 | 7/1980 | Helms | 220/270 |
| 4,258,876 | 3/1981 | Ljungerantz | 229/43 |
| 4,274,563 | 6/1981 | Otterson | 222/480 |
| 4,308,979 | 1/1982 | Otterson | 222/480 |
| 4,363,420 | 12/1982 | Andrews | 220/359 X |
| 4,489,864 | 12/1984 | Davis | 222/541 |
| 4,541,541 | 9/1985 | Hickman et al. | 220/253 |
| 4,624,386 | 1/1986 | Grigorenko et al. | 220/258 X |
| 4,705,197 | 11/1987 | Gordon et al. | 206/604 |
| 4,735,335 | 4/1988 | Torterotot | 220/270 |
| 4,759,463 | 7/1988 | Mazoin | 220/270 |
| 4,789,082 | 12/1988 | Sampson | 222/541 X |
| 4,792,054 | 12/1988 | Weidman | 222/23 |
| 4,817,816 | 4/1989 | Leseman et al. | 220/258 X |
| 4,938,390 | 7/1990 | Markva | 222/541 X |
| 4,969,572 | 11/1990 | van Kerkhoven et al. | 222/541 X |
| 5,103,973 | 4/1992 | Sato | 220/258 X |
| 5,167,338 | 12/1992 | Kick | 222/541 X |

FOREIGN PATENT DOCUMENTS

| | | | |
|---|---|---|---|
| 439268 | 7/1991 | European Pat. Off. | 222/548 |

*Primary Examiner*—Andres Kashnikow
*Assistant Examiner*—Anthoula Pomrening

[57] ABSTRACT

An injection molded thermoplastic closure for a container having a generally planar wall and an integrally molded push-in tab within the area of the wall. The push-in tab has its boundary formed by discontinuities in the closure wall and the discontinuities are hermetically closed with a sealant applied locally in an arcuate pattern by rotation of the closure relative to a sealant applicator. A hinge line of the push-in tab has a construction that improves hinge integrity.

13 Claims, 3 Drawing Sheets

ROTOR-TYPE DISPENSER

This is a continuation of Ser. No. 07/808,372, filed Dec. 16, 1991, now abandoned.

BACKGROUND OF THE INVENTION

The invention relates to dispensing closures for containers and, more particularly, to an improved push-in tab structure suitable for use in rotor/base type closures.

PRIOR ART

It is axiomatic that cost is a major factor in the commercial acceptance of disposable packaging. One type of container that has been cost effective is a composite can fitted with a plastic end closure of the rotor/base type. Typically, the base is made of styrene because of its relatively low cost and suitability for containing a multitude of products including food products.

U.S. Pat. Nos. 3,851,792, 3,851,812, 3,881,639, 3,907,156, 3,912,128, 4,274,563, 4,308,979, 4,489,864, 4,541,541 and 4,792,054, assigned to the assignee of the present invention are some examples of the prior art. Commonly, a rotor/base type closure has a push-in tab integrally formed in the base. A problem in the construction of such push-in tabs is the conflict between achieving a low release force for opening the tab and achieving a reliable seal at its boundary. These low force and sealing functions are ordinarily opposed so that an increase in the performance of one function usually results in a decrease in the performance of the other. The opening force and seal reliability problems are particularly troublesome when the base is injection molded of styrene or a like material. A low opening force, where the push-in tab has its boundary completely sealed by a continuum of the base material requires a locally very thin wall. The requisite thin wall boundary is very difficult to mold with consistency under high volume production. If the thin wall boundary of the tab is increased in thickness to assure a seal, the opening force is increased proportionately. Also, there is a possibility of a styrene push-in tab to separate into pieces if struck with a violent force with the attendant risk that a broken piece of the tab will fall into the product in the associated container. Still further, where the tab is intended to remain attached to the base through a living hinge after being opened, there has been a difficulty in maintaining hinge integrity while at the same time affording a construction in which the tab can be permanently bent on the hinge to an open position where it does not unduly obstruct dispensing of product through the tab opening.

SUMMARY OF THE INVENTION

The invention provides an injection molded thermoplastic dispensing closure with an improved push-in tab that provides a reliable hermetic seal, opens under an easily managed force and reduces the risk of fragmentation or whole separation from the associated closure body. As disclosed, the tab has a straight integral hinge and a remaining boundary line that becomes a free edge when the tab is opened. In the illustrated embodiment, when the tab is formed, the boundary line is defined for the most part by gaps or zones of complete separation between the tab and surrounding areas of the closure body. At one or more intermediate points along the boundary line an integral frangible bridge can be provided to ensure that the tab remains in place before it is deliberately opened by a user. The gaps are hermetically sealed by a settable sealant material applied on a suitable face of the closure.

One aspect of the invention involves a novel manner in which the sealant material is applied to the closure body. Where the closure body is round or has other characteristics, it may be difficult or costly to orient it in automatic handling equipment at high rates of production for purposes of locating the tab. In accordance with the invention, the closure body is rotated about an axis perpendicular to its plane relative to a sealant applying device. This novel technique allows sealant to be applied in an arcuate zone that encompasses the portion of the tab which, because of the gaps at its boundary, is discontinuous with the adjacent areas of the closure body.

Another aspect of the invention involves the geometry of the hinge area of the push-in tab. It has been discovered that, surprisingly, the strength and durability of the living hinge can be greatly improved by forming the hinge line with a notch or wall reduction area on the inside face of the closure body. This wall geometry, it is believed, improves the alignment of molecules of the plastic material forming the closure body at the hinge and puts the material closest to the notch in compression so that a tendency for a stress crack to occur or propagate from the surface of this notch is greatly reduced.

The disclosed dispensing closure has improved performance because of its ease of opening and its reduction of risk that the push-in tab will become fragmented or completely separated from the closure body. Since a large portion of the boundary line of the free edge of the tab can be formed so that it is discontinuous from adjacent areas of the closure body only a low force is required to open it. As a result, the tab has the potential to resist fracturing even when an excessive violent blow is struck by a user to open it since it can break away from the blow before a fracture develops. Since the tab yields to open at a relatively low force level, the hinge line is also less likely to be subjected to a level of force that could fracture it.

DESCRIPTION OF THE PREFERRED EMBODIMENT

Figure 1:
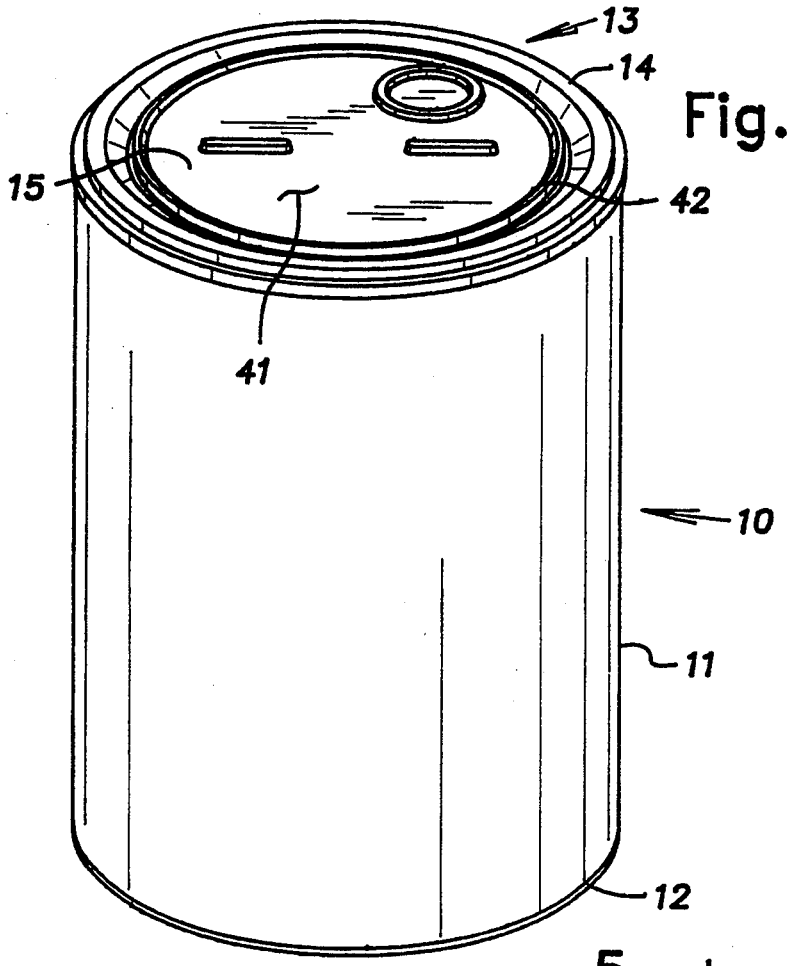
FIG. 1 is a schematic perspective view of a container on which the dispensing closure of the invention is fitted.
Figure 2:
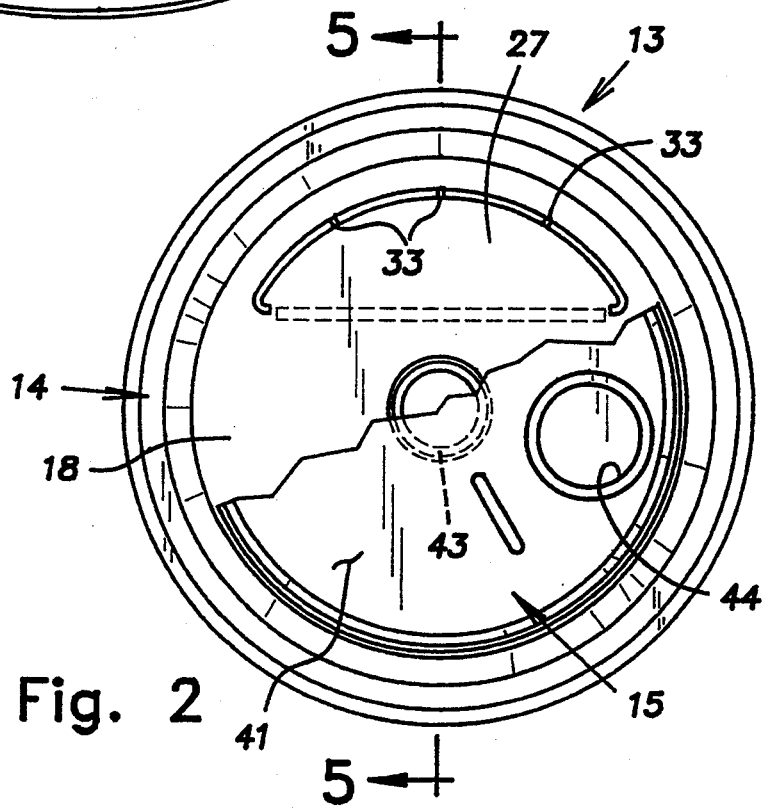
FIG. 2 is a top view of the dispensing closure with a portion of its rotor broken away to reveal an underlying part of the base constructed in accordance with the invention.

Referring now to the drawings, there is illustrated in FIG. 1 a container assembly 10 which in the illustrated example includes a composite can 11 and a metal bottom end wall 12, both known in the trade. A dispensing end closure 13 for the container assembly 10 is constructed in accordance with the invention. The end closure 13 is an assembly of a base 14 and a rotor 15. The base 14 is preferably manufactured as an injection molded part. Ideally, the base 14 is formed of styrene or other suitable thermoplastic material. Styrene is particularly suited for making the base part 14 because it is relatively inexpensive, is compatible with food products, and has a requisite fracturability for a push-in opening tab described below. The base 14 is round in end view and, accordingly, is suited for use in high speed automatic handling and assembling equipment. The base 14 includes a generally cylindrical skirt 17 that has a slightly tapered lower end to facilitate its assembly into the mouth of the composite can 11. The base 14 has a circular end wall 18 of generally uniform nominal wall thickness which may be, for example, 0.028 inches where the skirt diameter is nominally 3 inches. An outer peripheral shoulder 19 is adapted to abut an upper edge of the can 11 when the base 14 is joined to the can. A suitable glue or sealant can be applied between the skirt 17 and inner surface of the can 11 adjacent its mouth to provide a hermetic seal between these elements. The end wall 18 is recessed downwardly from a flange 22 so that when the rotor 15 is assembled on the base 14 against an outer surface 23 of the end wall 18, the rotor 15 lies completely below a plane of the uppermost area of the flange 22. This helps to protect the rotor and base assembly from damage during handling, shipping and storage of the container assembly 10.

A round hole 26 is formed in the base 14, in the illustrated case, at the geometric center of the base, to provide a pivot center for the rotor 15. A push-in tab 27 is integrally molded in the end wall 18. The tab 27 has a generally straight hinge line 28 and a boundary line 29. In the illustrated case, the boundary line is curvilinear so as to give the tab a crescent-like or kidney shape. More specifically, the boundary line 29 is concentric with the center of the hole 26.

Figure 3:
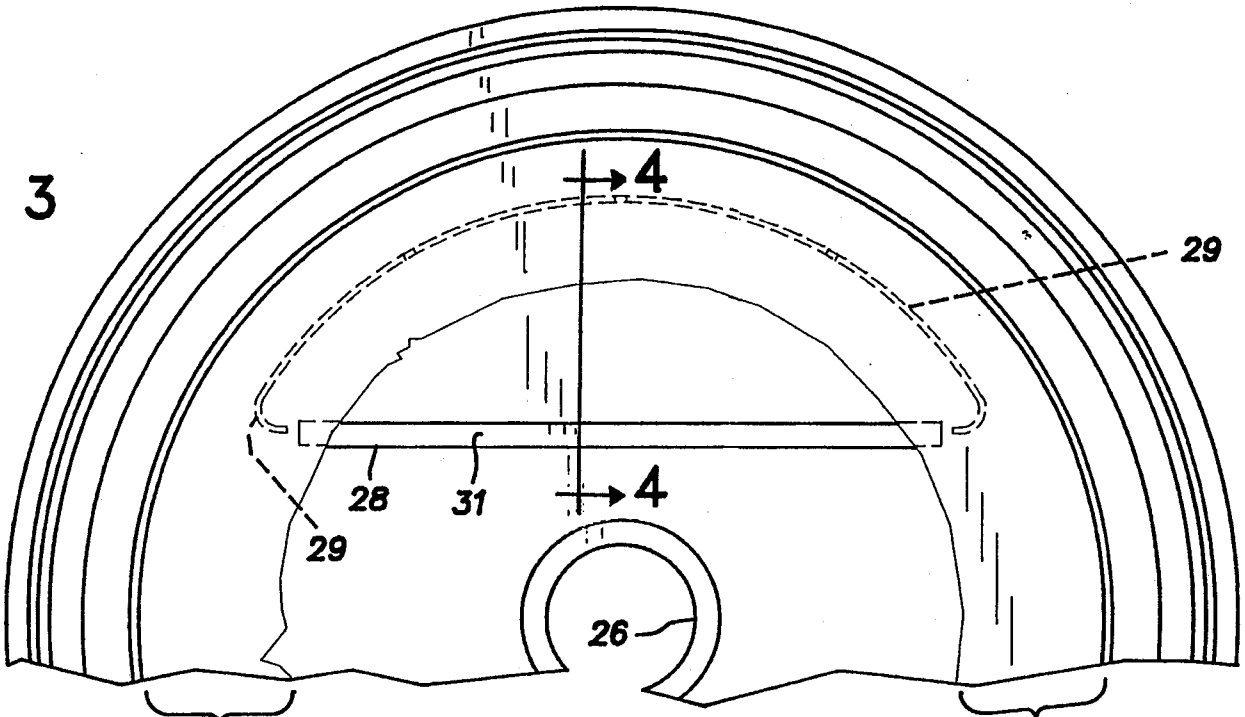
FIG. 3 is a bottom view of the closure base.
Figure 4:
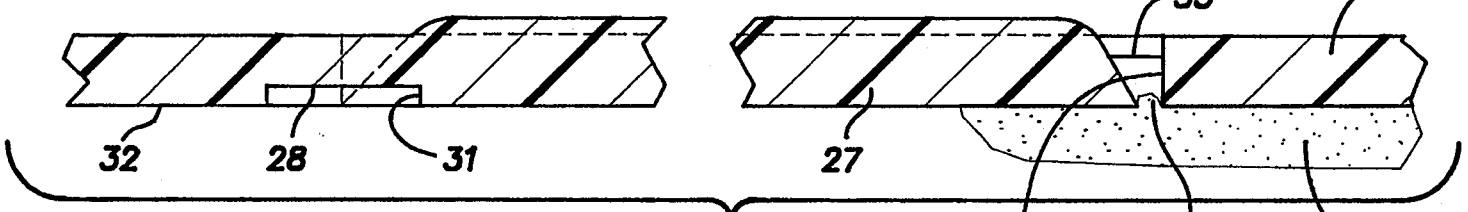
FIG. 4 is an enlarged fragmentary cross-sectional view of the base push-in tab area taken along the line 4—4 in FIG. 3.

As seen most clearly in FIGS. 3 and 4, the hinge line 28 is defined by a straight chordal notch 31 on an inner face 32 of the base end wall 18. The notch 31 is of generally uniform cross-section along the full length of the hinge line 28 and in the illustrated case has a cross-section which is rectangular.

Figure 5:
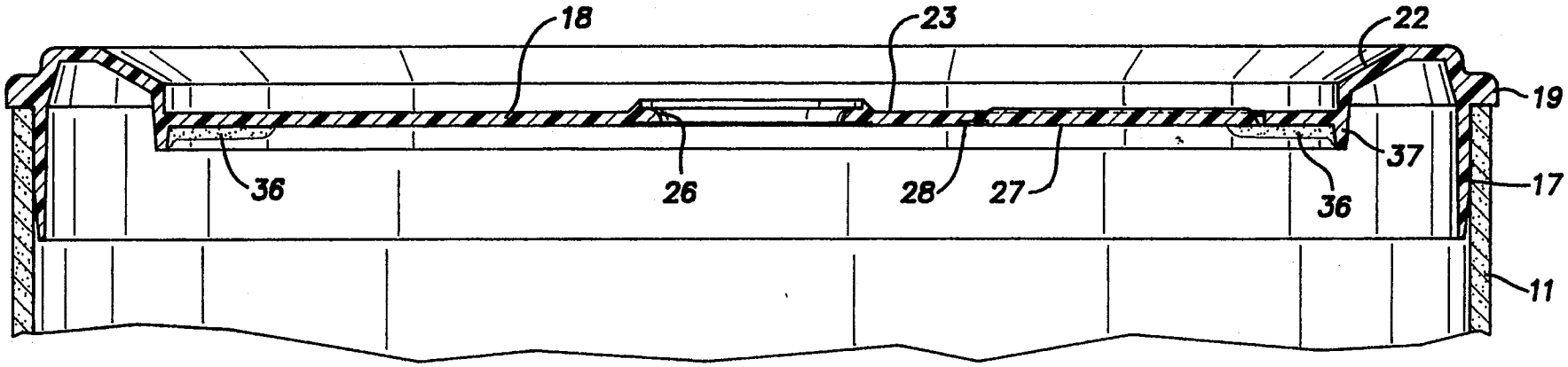
FIG. 5 is an enlarged fragmentary cross-sectional view of the closure base, with the rotor omitted for clarity, taken along the line 5—5 in FIG. 2.
Figure 6:
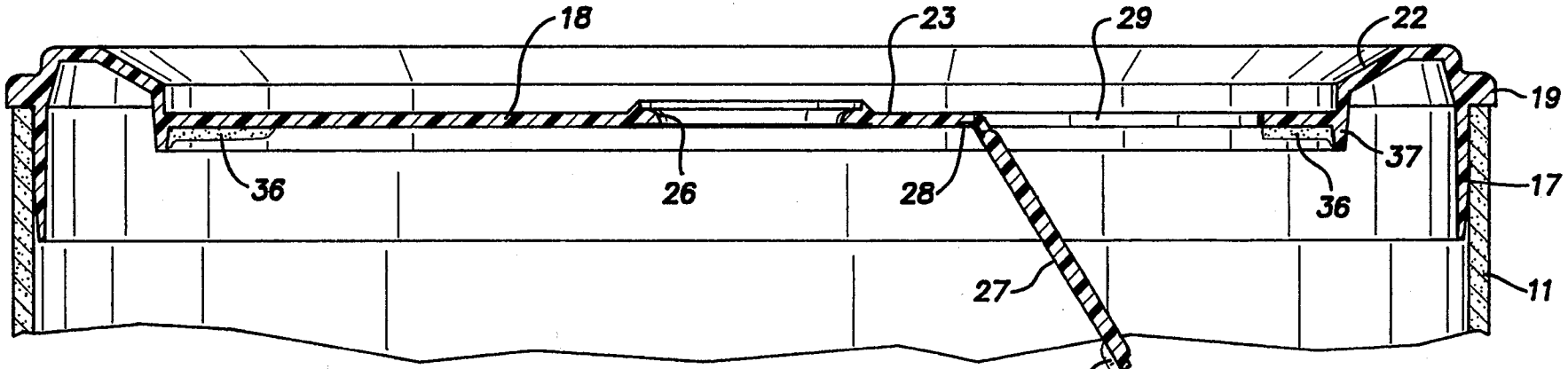
FIG. 6 is a view similar to FIG. 5 with the push-in tab opened.

The boundary line 29 is defined by a series of discontinuities or gaps 34 in the end wall 18 separating the tab 27 from adjacent surrounding areas of the end wall. The width of the gap 34 may range between 0.002" to 0.010", for example. One or more bridges 33 of base material can extend integrally between the end wall areas surrounding the tab 27 and the tab to provisionally maintain the tab in its original closed position. The number, size and configuration of the bridges 33 is determined by various factors including the size of the tab 27 and the rigors of handling and shipping that can be expected. With reference to FIGS. 3, 5 and 6, an arcuate or annular pattern of sealing material 36 is deposited on the inner face 32 of the base end wall 18 so that it completely envelopes or encompasses the discontinuities 34 in the boundary line 29. The material 36 is preferably applied as a flowable but suitable material. One type of suitable material is a hot melt paraffin wax base material known in the art for sealing composite cans which is capable of being sprayed or otherwise applied on the base in the illustrated pattern.

In high speed processing, particularly where the base, as illustrated, is round and especially where the tab 27 and other formations on the base are not readily and reliably physically, optically or otherwise discriminated, it can be relatively expensive and, therefore, impractical to orient the base so that an application of sealant material or other sealing provisions can be applied only to the exact location of a push-in tab. In the present invention, the base 14 is rotated in the plane of its end wall 18 about an axis through its center in a suitable chuck or like device while hot melt sealing material 36 is sprayed from a stationary nozzle directed at a zone through which the tab 27 travels. The material 36 can be continuously sprayed while the base 14 makes several full rotations in front of the spray nozzle so that several coats of material are applied. It has been found that good results are obtained when the base is caused to rotate at least three full turns while the spray nozzle is operating. A short circumferentially continuous lip or skirt 37 depends from the end wall 18 to contain the sealant material 36 against centrifugal force while the base is rotating and the material is flowable. It can be seen that the outside diameter of the annular pattern of sealant 36 is at this lip 37; the inside diameter of the sealant pattern is sufficiently close to the center of the base that the radial width of the pattern is certain to cover the tab boundary line 29 where the end wall 18 is discontinuous.

The rotor 15 is preferably a thermoplastic injection molded part. The rotor 15 is generally circular in shape with a wall 41 of generally uniform thickness and with a peripheral flange 42. An integral post 43 at the geometric center of the rotor 15 is snapped into the center hole 26 of the base 14. The post 43 connects the rotor 15 and base 14 for pivotal or rotational movement about their respective centers. An aperture 44, formed in the wall 41, is alignable by rotation of the rotor 15 with the area of the push-in tab 27.

A user opens the container assembly 10 by pressing on the tab 27 through the aperture 44 with an implement such as a spoon, fork or knife or with a finger, if desired. The tab opens when the shear strength of the sealing material 36 and bridges 33 is exceeded. Continued force on the tab 27 causes the tab to permanently bend or fold at the hinge line 28. The shear strength of the sealing material 36 is selected to be relatively low in comparison to that of the material of which the base 14 is constructed. This affords a relatively low opening force for the tab 27, it being understood that the bridges 33 have only minimal strength and that the sealant material 36 presents very little resistance to shearing. At the same time, however, the sealant material is effective to provide a hermetic seal across any discontinuity or gap 34 in the boundary line 29 until the tab is deliberately opened.

It has been found that, surprisingly, the living hinge formed at the hinge line 28 by the thinning out of the wall 18 at this line is quite durable and resistant to fracture particularly when the base is formed of styrene. The disclosed geometry of this living hinge at the hinge line 23 departs from conventional practice where a notch or thinning out to form a hinge line is provided on an outer face of an end wall in which is formed a push-in tab. It is believed that the increase in strength of this hinge area results from the avoidance of stress risers in the wall area of the hinge that is placed in tension upon bending of the wall when the tab is opened and from the provision of a molecular structure in this tensioned area that is uniform or uninterrupted.

It will be understood that when the push-in tab 27 is in the open position as illustrated in FIG. 5, the contents of the container 10 can be dispensed by pouring out product through the resulting opening and through the aperture 44. The container is thereafter closed by rotating the rotor so that the rotor aperture 44 is completely displaced from the opening left by the tab 27. The rotor can have multiple apertures of different size as is customary.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. An end wall for a container, the end wall having an integral push-in tab that, when pushed in, forms an opening in the end wall for dispensing contents from the container, the push-in tab having a hinge line at which the tab is supported when pushed in, the push-in tab having a boundary line that defines a free edge of the tab when it is pushed into the container, the boundary line including lines in the end wall where a discontinuity in the end wall exists between the tab and adjacent portions of the end wall, a settable sealant material coated and set in-situ in arcuate a circumferentially continuous annular pattern across the tab and adjacent portions of the end wall where any discontinuity in the boundary line exists so as to form a hermetic seal at any such discontinuity.

2. An end wall as set forth in claim 1, wherein said settable material is disposed on a side of the end wall that faces an interior of the container with which it is associated.

3. An end closure assembly comprising a thermoplastic injection molded round base and a rotor, means connecting the rotor on the base for pivotal movement about a center of movement, the base and rotor each having a generally planar configuration formed by a wall of generally uniform nominal wall thickness and inside and outside faces, the rotor being disposed with its inside face towards the outside face of the base, a push-in tab integrally formed in the base, the tab having a hinge line and a boundary line, the boundary line including discontinuities where the wall of the base is non-existent between the tab and an adjacent portion of the wall of the base, an annular deposit of settable sealant material set in-situ on the base having its center coincident with a geometric center of the base, the annular deposit encompassing the boundary line where the discontinuities exist so as to provide a hermetic seal across the boundary line, the sealant material having a minimal shear strength whereby it affords negligible resistance to opening of the tab such that the opening force required to displace the tab is readily controlled by the extent of discontinuity between the tab and the adjacent portion of the wall of the base along the boundary line, the rotor having an aperture, the aperture being arranged such that upon pivotal movement of the rotor the aperture overlies an opening formed by the tab when it is pushed in and upon further rotor movement, the aperture can be displaced completely from overlying relation with the tab opening to a position where an imperforate zone of the rotor wall overlies the tab opening to reclose the container.

4. An end closure assembly as set forth in claim 3, wherein the sealant material is disposed on the side of the base opposite the rotor.

5. An end closure assembly as set forth in claim 4, wherein the center of movement of the rotor is coincident with the geometric center of the base.

6. An end closure assembly as set forth in claim 5, wherein the center of movement of the rotor is coincident with its geometric center.

7. An end closure assembly as set forth in claim 6, wherein the tab has a crescent shape.

8. An end closure assembly as set forth in claim 3, wherein the push-in tab hinge line is formed by a straight notch in the wall of the base on the side of the base opposite the rotor.

9. A wall for a container comprising an injection molded thermoplastic body, a displaceable tab molded integrally on the wall, the tab when displaced from an original molded position forming an opening in the wall for dispensing contents from the container, the tab having a boundary line that defines a free edge of the tab when it is displaced from its original molded position, the boundary line including at least one line in the wall where a molded-in discontinuity in the wall exists between the tab and adjacent portions of the wall the discontinuity including a gap that has a dimension substantially in the range of between 0.002 to 0.010 inches, and a settable sealant material coated and set in-situ across the tab and adjacent portions of the wall where any discontinuity gap in the boundary line exists so as to form a hermetic seal at any such discontinuity.

10. A wall for a container as set forth in claim 9, wherein the wall includes interior and exterior sides and the discontinuity is formed by a groove with opposed surfaces that provide a groove width that varies in a direction extending between the interior and exterior sides of the wall.

11. A wall for a container as set forth in claim 10, wherein the groove is relatively wide adjacent the exterior side and relatively narrow adjacent the interior side.

12. A wall for a container as set forth in claim 11, wherein the variation in width of the groove is provided by a first of the opposed surfaces on the tab angled with respect to said direction and a second of said opposed surfaces being substantially aligned with said direction.

13. A wall for a container as set forth in claim 12, wherein the wall includes arcuately spaced bridges extending between said opposed surfaces, said bridges being adapted to be sheared when said tab is pressed into an interior of the container.

* * * * *

UNITED STATES PATENT AND TRADEMARK OFFICE

CERTIFICATE OF CORRECTION

PATENT NO. : 5,402,921

DATED : April 4, 1995

INVENTOR(S) : Michael J. Forsyth et al.

It is certified that error appears in the above-indentified patent and that said Letters Patent is hereby corrected as shown below:

Column 5, line 26 (claim 1, line 11), delete "arcuate"

Signed and Sealed this

Fifth Day of December, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,402,921

DATED : April 4, 1995

INVENTOR(S) : Michael J. Forsyth et al

It is certified that error appears in the above-indentified patent and that said Letters Patent is hereby corrected as shown below:

On the title page: Item [73] Assignee: --Weatherchem Corporation, Cleveland, Ohio --.

Signed and Sealed this

Fifth Day of March, 1996

*Attest:*

*Attesting Officer*

BRUCE LEHMAN

*Commissioner of Patents and Trademarks*